US006010122A

United States Patent [19]

Weber

[11] Patent Number: 6,010,122

[45] Date of Patent: Jan. 4, 2000

[54] METHOD AND APPARATUS FOR PRODUCING HIGH PAGE COUNT SIGNATURES

[75] Inventor: William C. Weber, Bolingbrook, Ill.

[73] Assignee: Wallace Computer Services, Inc., Hillside, Ill.

[21] Appl. No.: 08/857,592

[22] Filed: May 16, 1997

[51] Int. Cl.[7] ..... B41L 43/00; B41L 43/04; B31B 1/14; B31F 1/08

[52] U.S. Cl. ..... 270/41; 270/32; 493/359; 493/458; 493/429

[58] Field of Search ..... 270/32, 41, 42, 270/58.01, 58.07, 4, 16; 493/458, 359, 324, 444, 429, 427

[56] References Cited

U.S. PATENT DOCUMENTS

| | | | |
|---|---|---|---|
| 1,753,764 | 4/1930 | Willard | 270/41 |
| 2,322,647 | 6/1943 | Luce | 270/32 |
| 2,914,318 | 11/1959 | McGarvey et al. | 270/32 |
| 3,758,102 | 9/1973 | Munn et al. | 270/69 |
| 3,834,689 | 9/1974 | Lee et al. | 270/41 |
| 3,866,900 | 2/1975 | Kebba | 270/32 |
| 3,948,504 | 4/1976 | Woessner et al. | 270/21 |
| 3,961,781 | 6/1976 | Funk | 270/20 |
| 4,106,148 | 8/1978 | Axelrod | 270/32 |
| 4,279,409 | 7/1981 | Pemberton | 270/41 |
| 4,349,185 | 9/1982 | Small et al. | 270/32 |
| 4,720,089 | 1/1988 | Richter | 493/458 |
| 4,969,862 | 11/1990 | Ehlscheid | 493/359 |
| 5,030,193 | 7/1991 | Breton et al. | 493/458 |
| 5,046,710 | 9/1991 | Vijuk | 270/37 |
| 5,078,374 | 1/1992 | Odeau | 270/42 |

FOREIGN PATENT DOCUMENTS

| | | | |
|---|---|---|---|
| 724900 | 9/1942 | Germany | 270/32 |
| 0472234 | 2/1992 | United Kingdom | 270/32 |

*Primary Examiner*—William E. Terrell
*Assistant Examiner*—Wonki K. Park
*Attorney, Agent, or Firm*—Roylance, Abrams, Berdo & Goodman, L.L.P.

[57] ABSTRACT

A method and apparatus is disclosed for producing high page count signatures for printed publications. Signatures with a 96 page count and 128 page count are illustrated and described herein. In either case, the signature is constructed of four sheets of printed sheet materials which are preferably continuous webs of sheet material that are fed to a folding and cutting apparatus. The four sheets or webs are folded in half along a main longitudinal fold line extending in the direction in which the web travels. Preferably, the webs are perforated along the main longitudinal fold line prior to being folded. The webs, after being folded in half, are perforated to create a longitudinally extending hinge. Also, the webs are preferably perforated to create cross fold lines. In the case of the 96 page count signature, the folded webs are divided into thirds by the cross fold lines. The folded webs of the 128 page count signature are divided into fourths by the cross fold lines. The webs are then cut into sections which are folded along the fold lines to form the individual signatures.

11 Claims, 6 Drawing Sheets

METHOD AND APPARATUS FOR PRODUCING HIGH PAGE COUNT SIGNATURES

FIELD OF THE INVENTION

The present invention generally relates to the manufacture of magazines, books and the like from a plurality of signatures printed on web press machinery. More specifically, the present invention relates to a method and apparatus for producing high page count signatures such as 24 or 32 pages per folded web of sheet material.

BACKGROUND OF THE INVENTION

Printed publications such as books, magazines, periodicals, etc., are manufactured in a variety of ways. One method of manufacturing a printed publication, especially a large printed publication, is to print several pages of the publication onto a large sheet, and then fold the sheet into consecutive pages forming one portion of the overall publication This folded sheet of pages is known in the publication manufacturing art as a signature. A plurality of different signatures are joined together to form the complete publication.

Depending upon the size of the publication and the machines used to print and fold the signatures, several sheets of material can be used in each signature. For example, signatures constructed of four sheets can be printed on four separate, continuous webs of sheet material, and then folded and cut into a plurality of signatures. Currently, it is known to create signatures with 16 pages per sheet. Thus, a signature constructed of four sheets can have 64 pages.

If signatures with 64 pages were used to make a publication having a total of 960 pages, then 15 signatures would have to be assembled to create the publication. Such a publication would require 15 stations for combining the 15 signatures. Of course, a publication with more pages would require more stations. Accordingly, large publications result in a very large assembly line, which requires substantial floor space and many machines as well as operators to assemble the publication.

In view of the above, there clearly exists a need for creating a signature with a high page count. This invention addresses this need in the art as well as other needs in the art, which will become apparent to those skilled in the art from this disclosure.

SUMMARY OF THE INVENTION

One object of the present invention is to provide a method for producing high page count signatures for printed publications.

Another object of the present invention is to provide a method for producing signatures that minimize waste material.

Another object of the present invention is to provide a method for producing signatures utilizing comparatively conventional printing and folding apparatuses.

Still another object of the present invention is to provide a method of producing signatures which is relatively economical to manufacture.

A further object of the present invention is to provide a folding and cutting apparatus for producing signatures with high page counts.

Yet a further object of the present invention is to provide an apparatus which can be constructed from relatively conventional parts and machinery utilized in the publication manufacturing art.

Yet still another object of the present invention is to provide a high page count signature having 24 or 32 pages per sheet.

The foregoing objects are basically attained by providing a method of producing signatures for a printed publication, comprising the steps of providing at least one continuous printed web of sheet material with a plurality of pages printed on each side of the printed web; longitudinally folding the printed web in its direction of travel to form a first longitudinal fold line which divides the printed web into first and second main sections with the first and second main sections overlying each other; creating a set of longitudinally extending notches in the printed web to form a hinge extending substantially parallel to the first longitudinal fold line, and dividing each of the first and second main sections of the printed web into first and second subsections; severing the printed web into separate signatures; transversely folding each of the signatures twice in a direction to form transverse fold lines which are substantially perpendicular to the first longitudinal fold line; and longitudinally folding each of the signatures along the hinge formed by the notches.

Another aspect of the present invention is attained by providing a folded signature for a printed publication, comprising at least one web of sheet material with a first printed side forming a first set of pages and a second printed side forming a second set of pages; a first main fold line dividing the at least one web of sheet material into first and second main sections folded along the main fold line to overlie each other; a pair of second main fold lines substantially overlying each other and dividing each of the first and second main sections into first and second subsections; and at least first and second cross fold lines extending substantially perpendicular to the main fold lines and cooperating with the main fold lines to divide each of the first and second subsections into the first and second sets of pages, with the first and second set of pages being folded along the first and second cross fold lines to form a first folded stack of the first and second sets of pages on a first side of the second main fold line and a second folded stack of the first and second sets of pages on a second side of the second main fold line, the first and second stacks being folded along the second main fold line to overlie each other.

Moreover, the foregoing objects are further obtained by providing a folding and cutting apparatus for producing signatures for a printed publication from at least one continuous printed web of sheet material, comprising a first longitudinal folder arranged to receive and fold at least one printed web into first and second main sections; a notch forming device arranged to create a set of longitudinally extending notches in the at least one printed web to form a hinge; a cutter arranged to cut the at least one printed web into a plurality of signatures; a first cross folder arranged to individually fold the plurality of signatures in a direction substantially perpendicular to the first longitudinal folder; a second cross folder arranged to individually fold the plurality of signatures in a direction substantially parallel to the first cross folder; and a second longitudinal folder arranged to individually fold the plurality of signatures along the hinge of each of the plurality of signatures.

Other objects, advantages and salient features of the present invention will become apparent to those skilled in the art from the following detailed description, which, taken in conjunction with the annexed drawings, discloses two preferred embodiments of the present invention.

BRIEF DESCRIPTION OF THE DRAWINGS

Referring now to the attached drawings which form a part of this original disclosure.

BRIEF DESCRIPTION OF THE PREFERRED EMBODIMENTS

Figure 1A:
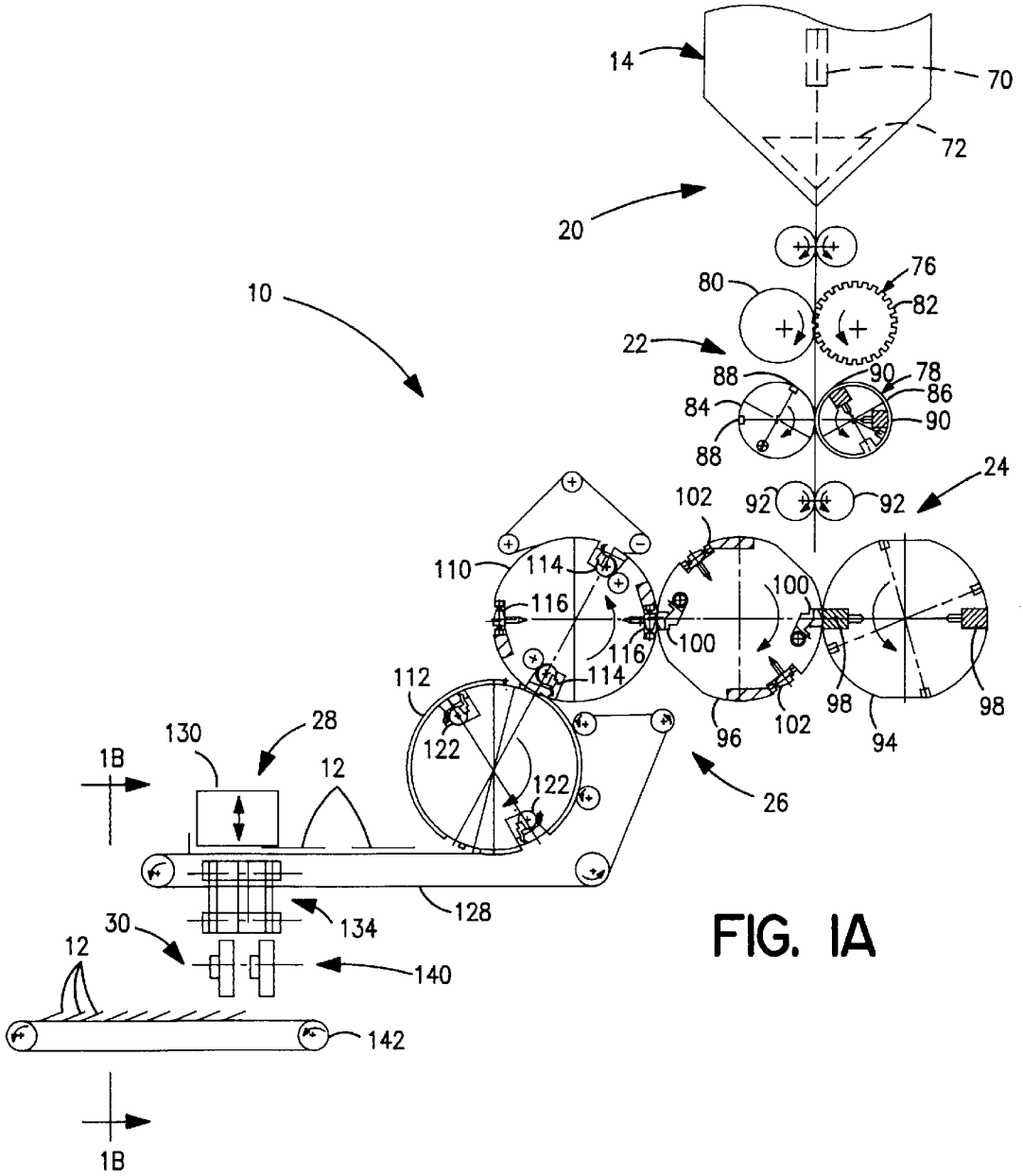
FIG. 1A is a schematic representation of a folding and cutting apparatus for producing high page count signatures in accordance with the present invention.
Figure 1B:
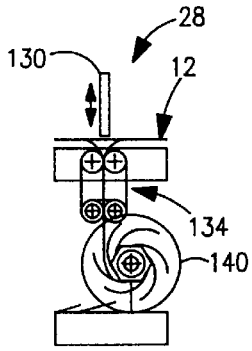
FIG. 1B is a partial end schematic representation of the folding and cutting apparatus illustrated in FIG. 1A as viewed along section line 1B—1B.
Figure 2:
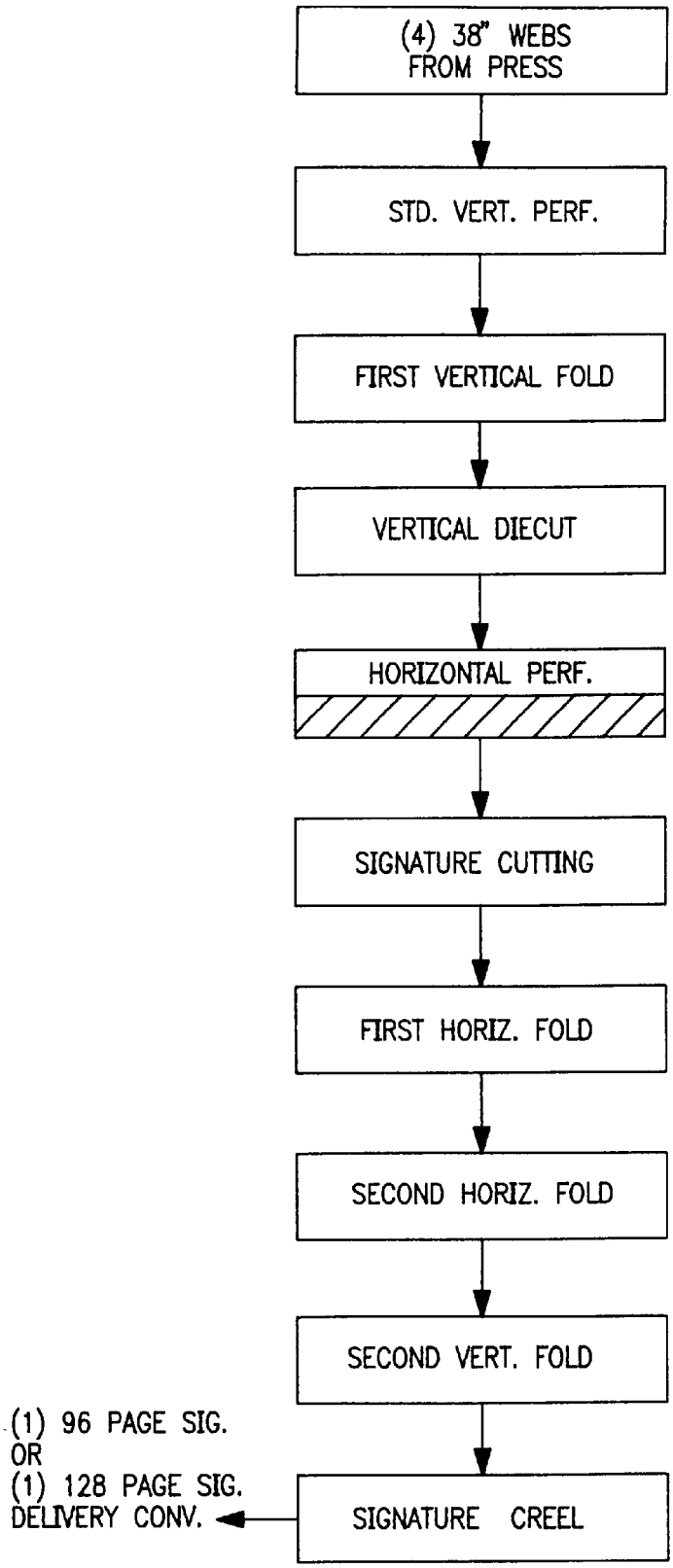
FIG. 2 is a flow diagram in block form depicting the operational sequence performed to fold and cut printed signatures from continuous webs of sheet materials in accordance with the present invention.

Referring initially to FIGS. 1A and 1B, a folding and cutting apparatus 10 in accordance with the present invention is illustrated for producing folded signatures 12 in accordance with the present invention. More specifically, a plurality of continuous, printed webs 14 of sheet material are fed directly from a conventional printing press (not shown) to folding and cutting apparatus 10 for continuously producing folded signatures 12. The steps of folding, perforating and severing of webs 14 into signatures 12 are set forth in FIG. 2. Basically, a section of webs 14 are twice longitudinally folded and twice cross folded.

Figure 3:
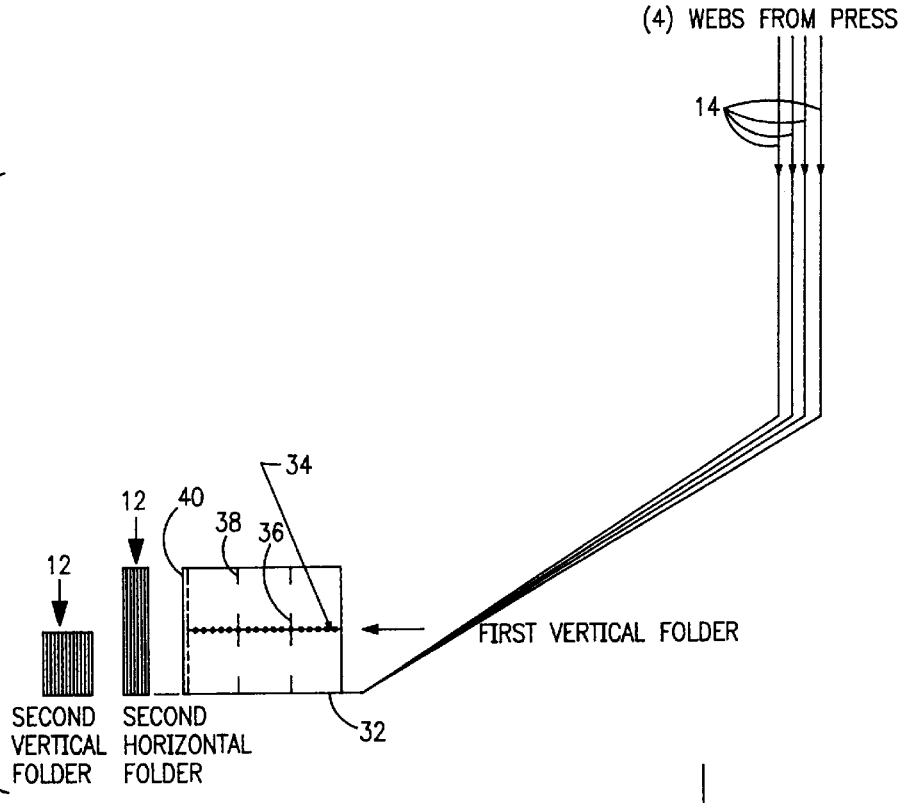
FIG. 3 is a side schematic representation of the webs from the printing press and depicting the folding and cutting of the printed webs to form a 96 page count signature.
Figure 4:
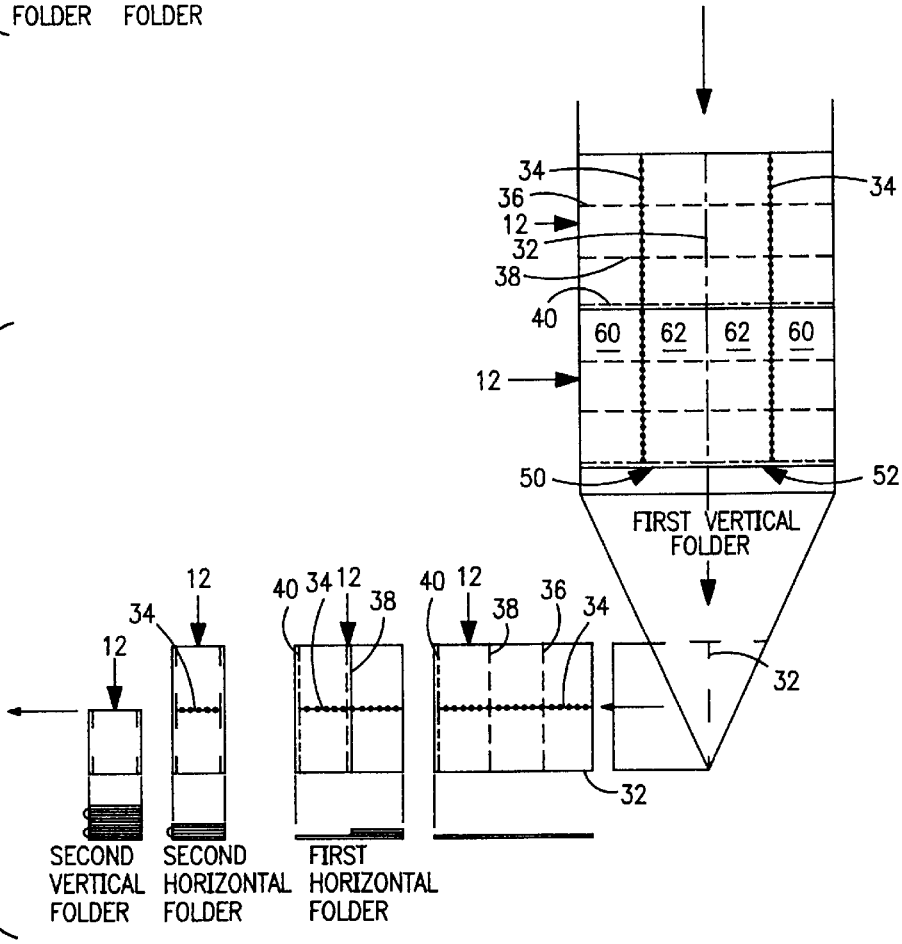
FIG. 4 is a top schematic representation of the webs from the printing press and depicting the folding and cutting of the webs to produce a 96 page count signature.

In the first illustrated embodiment our printed webs 14 of sheet material, as seen in FIGS. 3 and 4, are printed and severed to produce folded signatures 12 with ninety-six pages, i.e., twelve pages on each side of each portion of webs 14. It will be apparent to those skilled in the art from this disclosure that more or fewer sheets of printed webs 14 can be utilized in producing folded signatures 12 as needed or desired.

Webs 14 are typically printed on each of their sides with a different pattern of pages which repeats along the longitudinal length of each of the webs 14. When the webs 14 are folded and cut into signatures 12 via folding and cutting apparatus 10, the resulting signatures 12 will have the printed pages arranged in the correct sequential order. In the illustrated embodiment, the webs 14 are constructed from rolls of paper which are 38.0 inches wide. The paper forming webs 14 can be, for example, about 0.012 inch thick and cut to form a publication with pages having a height of about 9.0 inches and a width of about 7.25 inches.

As seen in FIGS. 1A and 1B, folding and cutting apparatus 10 basically includes an infeed section 20, a perforation section 22, a cutting section 24, a horizontal/cross folding section 26, a vertical/longitudinal folding section 28 and a signature delivery section 30. Folding and cutting apparatus 10 is preferably constructed from relatively conventional components which are well-known in the publication producing art. For example, folding and cutting apparatus 10 can be constructed by modifying a Hantscho MK4 Folder such that it folds and cuts the webs 14 in accordance with the present invention to produce a high page count signature as explained below. Since folding and cutting apparatus 10 can be constructed of relatively conventional components, the details of the various components of folding and cutting apparatus 10 will not be discussed or illustrated in detail herein.

Figure 5:
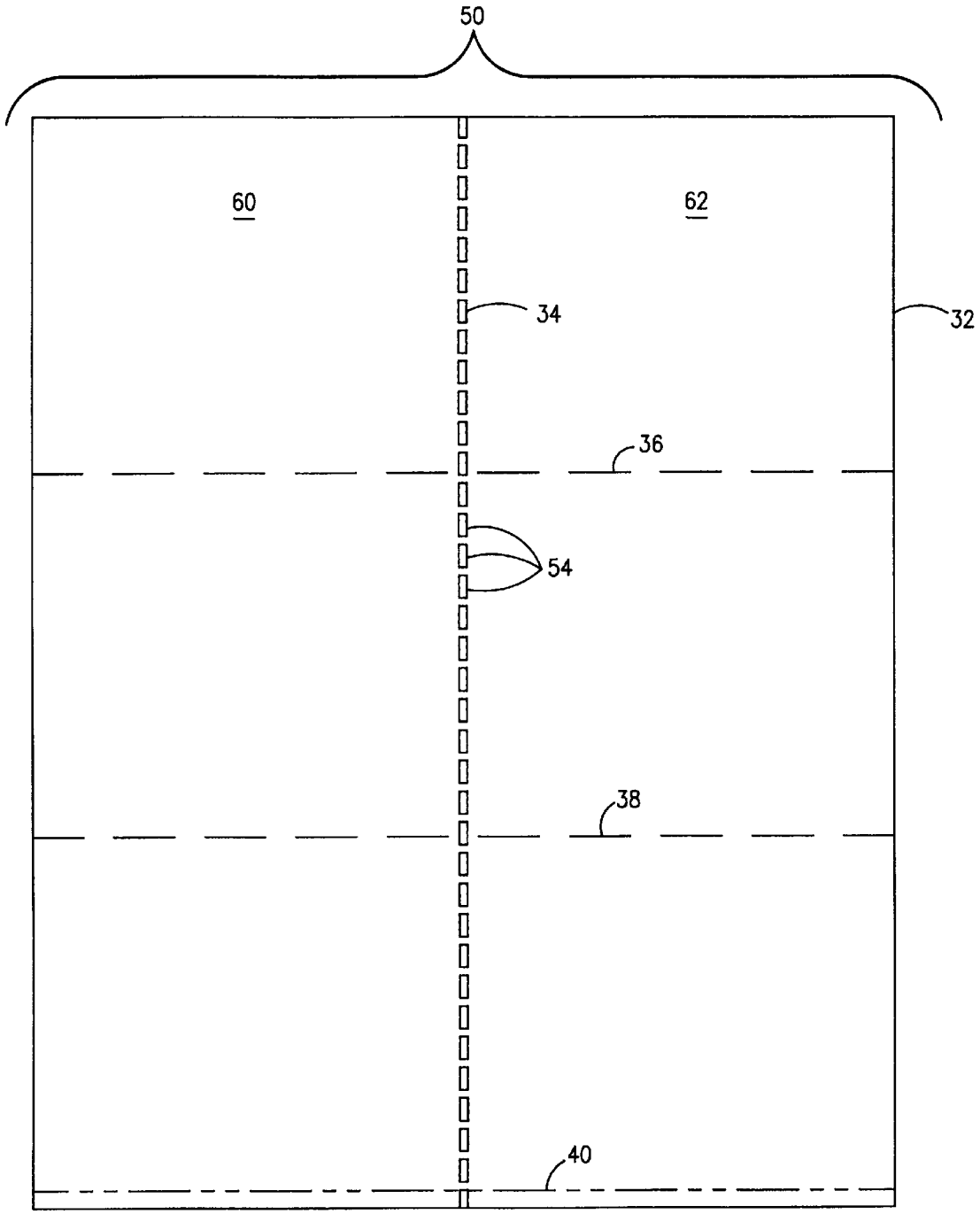
FIG. 5 is an elevational view of a signature page after being folded in half along its longitudinal axis and after being perforated, but prior to being folded along the horizontal perforations and the vertical hinge.

Referring now to FIGS. 3–5, each web 14 is perforated, folded and cut to form folded signatures 12 by folding and cutting apparatus 10 (FIGS. 1A and 1B). In the first illustrated embodiment, four webs 14 are utilized to create a ninety-six page count signature. Since each web 14 is perforated, cut and folded together to form signatures, it will be apparent to those skilled in the art from this disclosure that the references to perforations and fold lines apply to each of the webs 14.

In producing the ninety-six page count signatures 12, webs 14 are cut approximately every 23.56 inches such that each side of the webs 14 can form twelve pages of a printed publication. Accordingly, since there are four sheets of webs 14 in each of the folded signatures 12, a four sheet signature in accordance with the first embodiment of the present invention has a total of ninety-six pages. Folded signatures 12 are used to construct a printed publication having final dimensions approximately of 7.25 inches by approximately 9.0 inches after the signatures 12 are trimmed in accordance with conventional methods which are well-known in the publication making art.

Each of the severed webs 14, which form folded signatures 12, includes a first vertical (longitudinal) perforation or fold line 32, a pair of second vertical (longitudinal) perforation or fold line 34, a first horizontal (cross) perforation or fold line 36, a second horizontal (cross) perforation or fold line 38 and a plurality of pin holes 40.

The terms "horizontal" and "vertical" as used herein to describe the construction of signatures 12 from webs 14 refer to a particular orientation of an element of the signatures 12 as the signatures 12 pass through apparatus 10. Of course, the terms "horizontal" and "vertical" should not be used to limit the present invention. In particular, "horizontal" as used herein refers to something oriented transverse to the longitudinally direction of travel of webs 14, while "vertical" refers to something oriented parallel to the longitudinal direction of travel of webs 14.

The perforations forming the fold lines in the webs 14 basically serves two functions. First, the perforations of the webs 14 assist in the folding of the webs 14. Second, the perforations in the webs 14 also allow air to pass through webs 14 such that air does not get trapped between adjacent webs and/or the components of apparatus 10. Of course, it will be apparent to those skilled in the art from this disclosure that depending upon the particular construction of apparatus 10, the perforations could be eliminated such that the webs 14 are folded without perforations.

As best seen in FIG. 4, first vertical (longitudinal) perforation line 32 longitudinally divides webs 14 into first and second main sections or halves 50 and 52. When webs 14 are folded along perforation line 32, first and second main halves 50 and 52 overlie each other. Preferably, the perforations forming perforation line 32 are formed prior to severing webs 14 into sections to form the individual signatures 12. Of course, it will be apparent to those skilled in the art from this disclosure that with certain modifications, webs 14 could be severed prior to the forming of perforation line 32.

The pair of second vertical (longitudinal) perforation lines 34 are preferably formed in a single step. In particular, the pair of second vertical perforation lines 34 are formed after webs 14 are folded along first vertical perforation line 32. Thus, first and second main sections 50 and 52 overlie each other such that both sections 50 and 52 can be perforated in a single step. Of course, perforation lines 34 can be made prior to folding webs 12 along perforation line 32, if needed and/or desired. In any event, vertical perforation lines 34 are aligned when webs 14 are folded along perforation line 32, and are parallel when webs 14 are unfolded. In the preferred embodiment, the perforations forming perforation lines 34 are in the form of notches 54. These notches 54 are preferably each about ⅜ inch to about 1.0 inch in length and about ⅛ inch in width to form a hinge 56 in webs 14.

The hinge formed by vertical perforation lines 34 is preferably the final fold in forming the folded signatures 12. As it will be apparent to those skilled in the art from this disclosure, signatures 12 become relatively thick upon being folded over and over again. Accordingly, a hinge must be formed so that the sheets of the web can be folded to form a relatively flat signature which can be used to produce the printed publication.

As best seen in FIGS. 4 and 5, second vertical (longitudinal) perforation lines 34 divide each of the main sections 50 and 52 of webs 14 into first and second subsections 60 and 62, with subsections 60 and 62 of first main section 50 overlying subsection 60 and 62 of second main section 52, respectively. Accordingly, webs 14 in their fully unfolded position has four subsections created by perforation lines 32 and 34. Of course, when webs 14 are folded along perforation line 32, the subsections 60 and 62 are stacked such that eight subsections 60 are stacked or superimposed upon each other and eight subsections 62 are stacked or superimposed on each other.

As seen in FIGS. 3–4, horizontal (cross) perforation lines 36 and 38 transversely divide webs 14 into approximately thirds. In the preferred embodiment, one third is approximately 8.05 inches wide, a center third is approximately 7.81 inches wide and the final third is approximately 7.69 inches wide. Perforation lines 32, 34, 36 and 38 together divides webs 14 into pages. Preferably, the horizontal (cross) perforations 36 and 38 are formed in webs 14 prior to severing webs 14 into the individual signatures 12. It will also be apparent to those skilled in the art from this disclosure that depending upon the machinery, the perforations of perforation lines 36 and 38 may be omitted and the webs 14 can merely be folded without perforating webs 14.

As seen in FIGS. 3–4, pin holes 40 (illustrated as dashed lines) are preferably small holes formed along the leading edge of the webs 14 for pulling webs 14 through folding and cutting apparatus 10 as discussed below in more detail. Pin holes 40 are located in an area of each of the signatures 12 which will be trimmed off in forming the final printed publication.

Turning back to FIG. 1A, infeed section 20 of folding and cutting apparatus 10 is arranged to continuously receive printed webs 14 from the printing press (not shown) such that the printed webs 14 can be folded and cut into the folded signatures 12 in a substantially non-stop continuous manner. Infeed section 20 basically includes a perforating roller 70 for forming vertical perforation line 32 in webs 14 and a folding or forming board 72 for folding webs 14 along perforation line 32. Accordingly, infeed section 20 longitudinally perforates and folds webs 14 in half such that first and second main sections 50 and 52 overlie each other. In this folded position, webs 14 are folded in half such that essentially eight continuous webs of sheet material are now being fed through apparatus 10.

Perforating roller 70 is a conventional perforating roller which cuts or punches small perforations along the center of the webs 14 to form longitudinal perforation line 32. Since perforating rollers 70 are well-known in the publication producing art, perforating roller 70 will not be discussed or illustrated in detail herein. Although perforating roller 70 is preferably designed to nose perf webs 14, it will be apparent to those skilled in the art that other types of methods and/or apparatuses can be utilized to create perforation line 32 if desired. Moreover, perforating roller 70 could be eliminated, if needed and/or desired, i.e., webs 14 can be folded in half without perforations.

Forming board 72 is preferably a V-shaped forming board which folded webs 14 in half in a conventional manner, i.e., folds webs 14 in half along perforation line 32. Examples of a web folding apparatus which can be utilized for folding webs 14 in half are disclosed in U.S. Pat. Nos. 3,834,689 to Lee et al. and 3,948,504 to Woessner et al. The entire disclosures of these two patents are hereby incorporated herein by reference. Since folding or forming boards are well-known in the art, folding or forming board 72 will not be discussed or illustrated in detail herein.

The folded webs 14 exit the infeed section 20 in a substantially vertical manner, and then enter perforation section 22. Perforation section 22 is designed to form perforation lines 34, 36 and 38. In particular, perforation section 22 includes a notch forming device 76 for forming perforation lines 34 and a cross perforator 78 for forming horizontal perforation lines 36 and 38. It will be apparent to those skilled in the art from this disclosure that notch forming device 76 and cross perforator 78 can be either two separate components or combined into a single component. Preferably, notch forming device 76 is incorporated into cross perforator 78. However, for purposes of illustration, notch forming device 76 and cross perforator 78 will be illustrated as two separate components.

As seen in FIG. 1A, notch forming device 76 preferably includes an anvil ring 80 and a notch blade 82 positioned adjacent anvil ring 80 for forming notches 54 within webs 14. Anvil ring 80 is designed to rotate about a horizontal axis which is perpendicular to the path of travel of webs 14. Likewise, notch blade 82 is also mounted for rotation about a horizontal axis which is perpendicular to the path of travel of webs 14. Anvil ring 80 rotates in an opposite direction from notch blade 82 such that anvil ring 80 and notch blade 82 cooperate together to engage and pull webs 14 therebetween. As webs 14 pass between anvil ring 80 and notch blade 82, notches 54 are cut into the eight layers of webs 14 such that each web 14 is now divided into two pairs of subsections 60 and 62. A scraper blade and vacuum (not shown) can be utilized to remove the scrap material created by notch blade 82 and anvil ring 80.

It will be apparent to those skilled in the art from this disclosure that notches 54 can be created by other types of devices such as laser cutting, water jet cutting. Also, the notch blade 82 could be modified to minimize or even eliminate chaff. Moreover, the notch forming device 76 can be placed downstream of the cross perforator 78 if needed and/or desired. In any event, notch forming device 76 should create a hinge which allows signatures 12 to be folded to form a high page count signature.

Cross perforator 78 basically includes an anvil roller 84 and a perforating roller 86. Anvil roller 84 and perforating roller 86 cooperate together in a conventional manner to form first and second horizontal perforation lines 36 and 38 in webs 14. In particular, anvil roller 84 and perforating roller 86 are each mounted for rotation about a horizontal axis extending substantially perpendicular to the path of travel of webs 14. More specifically, anvil roller 84 rotates in an opposite direction from perforating roller 86 such that they cooperate together to engage and pull webs 14 therebetween.

Anvil roller 84 has a pair of longitudinally extending anvils 88 which are spaced about the circumference of anvil roller 84 to engage a pair of perforating blades 90 formed in perforating roller 86. As web 14 passes between anvil roller 84 and perforating roller 86, perforating blades 90 sequentially engage webs 14 and anvils 88 to form horizontal perforation lines 36 and 38 in consecutive areas along webs 14. Preferably, perforation lines 36 and 38 are formed prior to severing webs 14 into the individual signatures 12.

From the perforating section 22, webs 14 pass through a pair of guide or nip rollers 92 which feed the continuous sheets of printed webs 14 into cutting section 24. In cutting section 24, the webs 14 are severed into sheets to form their individual signatures 12. Cutting section 24 basically includes a knife cylinder 94 and a pin cylinder 96. Knife cylinder 94 is provided with a pair of longitudinally disposed knife blades 98 positioned approximately 180° apart and supported by suitable holders in a conventional manner. Preferably, knife blades 98 are designed to be replaceable in a conventional manner.

Pin cylinder 96 is provided with two longitudinally extending sets of pins 100 which are spaced approximately 180° apart as well as a pair of folding blades 102 which are spaced 180° apart from each other and approximately 45° from one of the sets of pins 100. As webs 14 pass between knife cylinder 94 and pin cylinder 96, one of the set of pins 100 engages a transverse portion of webs 14 and then blades 98 of knife cylinder 94 sever webs 14 to create the individual signatures 12. The individual signatures 12 are now pinned to pin cylinder 96 and pass along the bottom half of pin cylinder 96 where they are conveyed to horizontal/folding section 26.

Horizontal/cross folding section 26 includes a single parallel folding cylinder 110 which cooperates with folding blades 102 of pin cylinder 96 for horizontally folding the partially folded signatures 12 for a first time, and a double parallel folding cylinder 112 for horizontally or cross folding the partially folded signatures 12 for a second time. Folding cylinders 110 and 112 are well-known in the art, and thus, will not be discussed in detail herein. Similar types of folding rollers are disclosed in U.S. Pat. No. 3,758,102 to Munn et al., the entire disclosure of which is hereby incorporated herein by reference.

Folding cylinder 110 is mounted for rotation about a horizontal axis and has a pair of gripping portions 114 and a pair of folding blades 116. Gripping portions 114 are spaced approximately 180° apart for cooperating with folding blades 102 of pin cylinder 96. The signatures 12 are forced by the blunt edge of folding blades 102 of cylinder pin 96 between a fixed jaw and a moveable jaw of one of the gripping portions 114 such that signature 12 are gripped along first horizontal perforation line 36 to fold the signatures 12. The signatures 12 are then conveyed about the upper half of folding cylinder 110 to where it engages the second folding cylinder 112.

Folding cylinder 112 includes a pair of gripping portions 122 having a moveable jaw and a fixed jaw for gripping signatures 12 from first folding cylinder for folding signatures 12 along second horizontal perforation line 38. The signatures 12 from first folding cylinder 110 are forced by the blunt edge of folding blades 116 of first folding cylinder 110 into engagement with gripping portions 122 of second folding cylinder 112. The second folding cylinder 112 grips signatures 12 along second fold line 38 to further fold signatures 12 therealong. In particular, the movable jaws and fixed jaws of gripping portions 122 grab signatures 12. The signatures 12 are then conveyed along the lower half of folding cylinder 112 to a set of guide belts 128 which conveys the signatures to vertical/longitudinal folding section 28.

As seen in FIGS. 1A and 1B, vertical/longitudinal folding section 28 performs the final vertical fold of signatures 12 along the hinge formed by perforations 34. Vertical/longitudinal folding section 28 basically includes guide belts 128, a pushing member 130 and a pair of gripping members 134. As the signatures 12 are conveyed along guide belts 128, the signatures 12 pass over a slot formed in the conveyer of guide belts 124. The pushing member 130 is timed to push the signatures 12 down through the slot. The signatures 12 are then gripped by guide rollers 134 which pull the signatures 12 downwardly. Pushing member 130 engages each of the signatures 12 along the hinge formed by perforations 34 to fold the signatures 12 in half such that each of the signatures has forty-eight superimposed sheets, i.e., ninety-six pages.

The gripping members 134 convey the folded signature 12 down to the signature delivery section 30 for subsequent delivery to additional publication producing equipment. Preferably, signature delivery section 30 includes a creel 140 and a conveyer 142. Creel 140 is a conventional piece of equipment which receives each of the signatures 12 for depositing the signatures 12 on conveyer 142 in a shingle-like fashion. The conveyer 140 is any conventional conveyer utilized to move the signatures to another machine or a stacking area. Since creel 140 and conveyor 142 are conventional pieces of equipment, they will not be discussed in detail herein.

SECOND EMBODIMENT OF FIGS. 6–8

Figure 6:
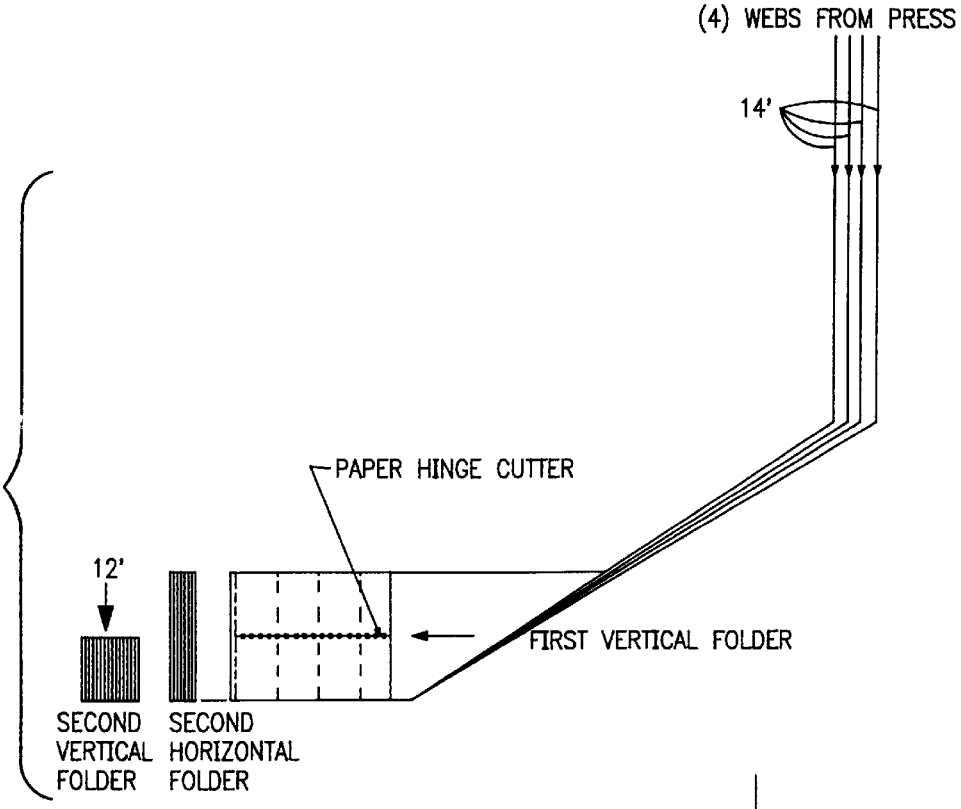
FIG. 6 is a side schematic representation of the webs from the printing press and depicting the folding and cutting of the printed webs to form a 128 page count signature.
Figure 7:
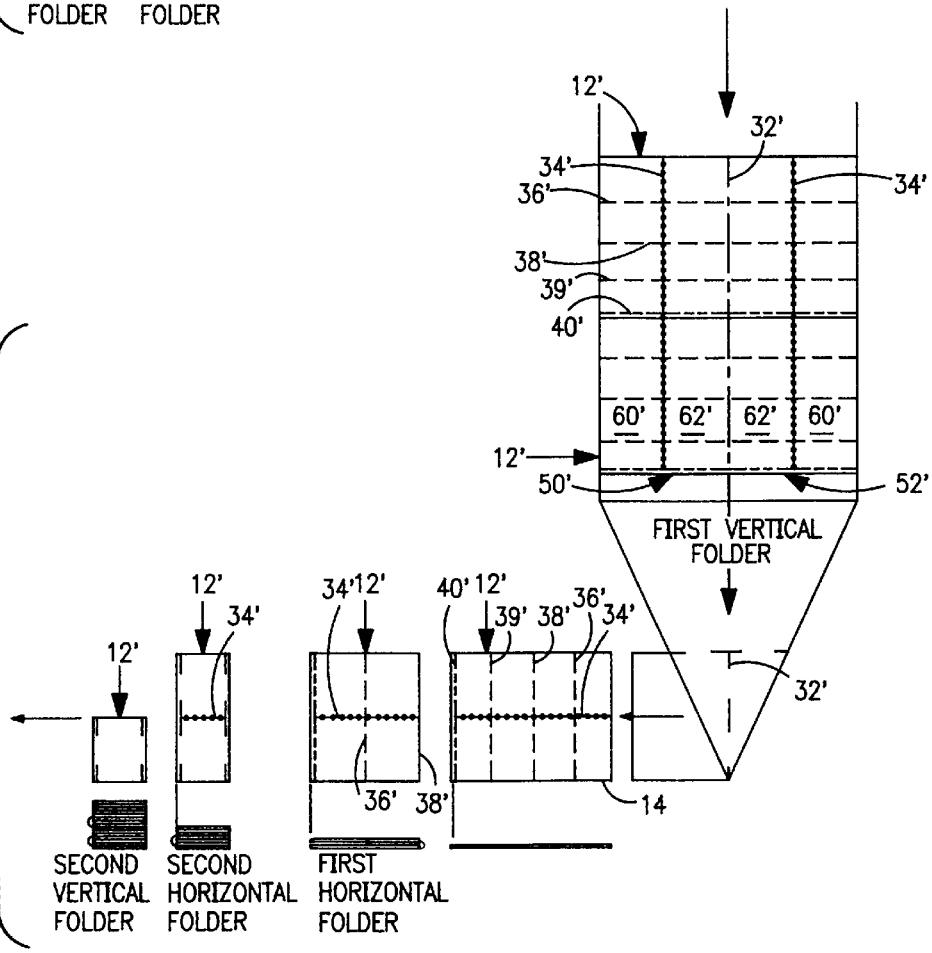
FIG. 7 is a top schematic representation of the webs from the printing press and depicting the folding and cutting of the webs to produce a 128 page count signature.
Figure 8:
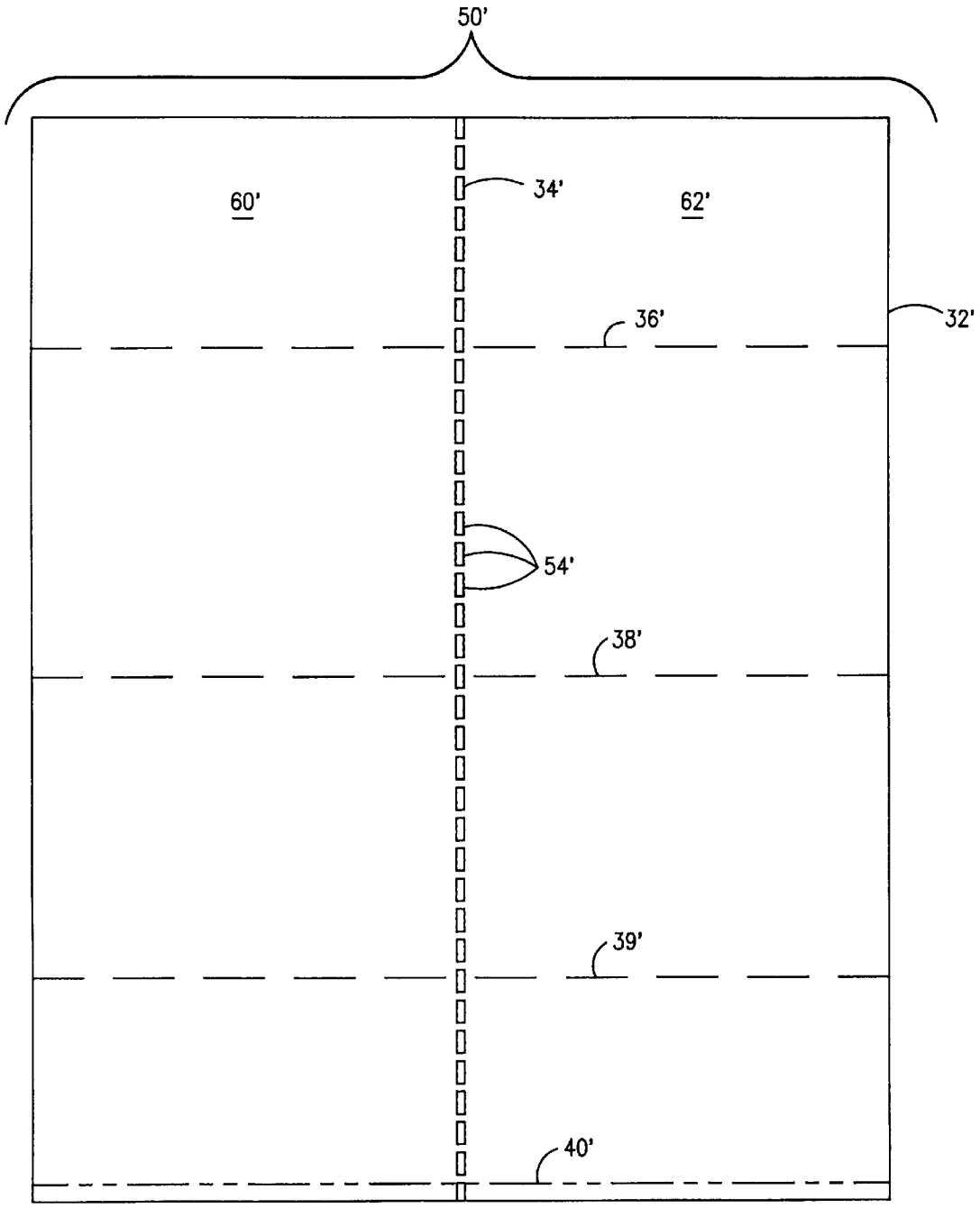
FIG. 8 is an elevational view of a signature page after being folded in half along its longitudinal axis and after being perforated, but prior to being folded along the horizontal perforations and the vertical hinge.

Referring now to FIGS. 6–8, a signature 12' in accordance with a second embodiment is illustrated. Signature 12' can be constructed utilizing apparatus 10, as discussed above, except that cross perforator 78 has three sets of perforating blades 90 to form three sets of parallel perforation lines and the folding cylinders 110 and 112 are modified to fold the signatures at different locations. In this embodiment, four printed webs 14' of sheet material are utilized to produce folded signature 12' with 128 pages. It will be apparent to those skilled in the art from this disclosure that more or fewer printed webs 14' can be utilized in producing folded signature 12' as needed or desired.

Webs 14' are typically printed on each of their sides with a different pattern of pages which repeats along the longitudinal length of each of the webs 14'. When the webs 14' are folded and cut into signatures 12' via folding and cutting apparatus 10, the resulting signatures 12' will have the printed pages arranged in the correct sequential order.

Each web 14' is perforated, folded and cut to form folded signatures 12' by folding and cutting apparatus 10. Since each web 14' is perforated, cut and folded together to form signatures, it will be apparent to those skilled in the art from this disclosure that the references to perforations and fold lines apply to each of the webs 14'.

In producing the 128 page count signatures 12', webs 14' are cut approximately every 23.56 inches such that each side of the webs 14' can form sixteen pages of a printed publication. Accordingly, since there are four sheets of webs 14' in each of the folded signatures 12', a four sheet signature in accordance with the second embodiment of the present invention has a total of 128 pages. Folded signatures 12' are used to construct a printed publication having final dimensions approximately of 5.50 inches by approximately 9.0 inches after the signatures 12' are trimmed in accordance with conventional methods which are well-known in the publication making art.

Each of the severed webs 14', which form folded signatures 12', includes a first longitudinally extending perforation or fold line 32', a pair of second vertical perforation or fold line 34', a first horizontal (cross) perforation or fold line 36', a second horizontal (cross) perforation or fold line 38', a third horizontal (cross) perforation or fold line 39' and a plurality of pin holes 40'.

First vertical or longitudinal perforation line 32' longitudinally divides webs 14' into first and second main sections or halves 50' and 52'. When webs 14' are folded along perforation line 32', first and second main halves 50' and 52' overlie each other. Preferably, the perforations forming perforation line 32' are formed prior to severing the webs 14' into sections to form the individual signatures 12'. Of course, it will be apparent to those skilled in the art from this disclosure that with certain modifications, webs 14' could be severed prior to the forming of perforation line 32'.

The pair of second vertical perforation lines 34' are preferably formed in a single step. In particular, the pair of second vertical perforation lines 34' are preferably formed in a single step after webs 14' are folded along first vertical perforation line 32'. Thus, vertical perforation lines 34' are aligned when the webs 14' are folded along perforation line 32', and are parallel when the webs 14' are unfolded. As in the first embodiment, the perforations of this second embodiment forming perforation lines 34' are in the form of notches 54'.

The hinge formed by vertical perforation lines 34' is preferably the final fold in forming the folded signatures 12'. As it will be apparent to those skilled in the art from this disclosure, signatures 12' become relatively thick upon being folded over and over again. Accordingly, a hinge formed by perforation lines 34' must be formed so that the sheets of the web can be folded to form a relatively flat signature.

Second vertical perforation lines 34' divide each of the main sections 50' and 52' of webs 14' into first and second subsections 60' and 62', with subsections 60' and 62' of first main section 50' overlying subsection 60' and 62' of second main section 52', respectively. Accordingly, webs 14' in their fully unfolded position has four subsections created by perforation lines 32' and 34'. Of course, when webs 14' are folded along perforation line 32', the subsections 60' and 62' are stacked such that eight subsections 60' are stacked or superimposed upon each other and eight subsections 62' are stacked or superimposed on each other.

Horizontal (cross) perforation lines 36', 38' and 39' transversely divide webs 14' into approximately fourths. Perforation lines 32', 34', 36', 38' and 39' all together divides webs 14' into sixteen pages per side. Preferably, the horizontal (cross) perforations 36', 38' and 39' are formed in webs 14' prior to severing webs 14' into the individual signatures 12'. It will also be apparent to those skilled in the art from this disclosure that depending upon the machinery, the perforations of perforation lines 36', 38' and 39' may be admitted and the webs 14' can merely be folded without perforating webs 14'.

Pin holes 40' are small holes formed along the leading edge of the webs 14' for pulling webs 14' through folding and cutting apparatus 10 as discussed below in more detail. Pin holes 40' are located in an area of each of the signatures 12' which will be trimmed off in forming the final printed publication.

While only two embodiments have been chosen to illustrate the present invention, it will be understood by those skilled in the art from this disclosure that various changes and modifications can be made herein without departing from the scope of the present invention as defined in the appended claims.

What is claimed is:

1. A method of producing signatures for a printed publication, comprising the steps of providing at least one continuous printed web of sheet material with a plurality of pages printed on each side of said printed web and moving said printed web in a longitudinal direction of travel;

longitudinally folding said printed web in its direction of travel to form a first longitudinal fold line which divides said printed web into first and second main sections with said first and second main sections overlying each other;

creating a set of longitudinally extending notches in said printed web to form a hinge extending substantially parallel to said first longitudinal fold line, and dividing each of said first and second main sections of said printed web into first and second subsections;

severing said printed web into separate signatures;

transversely folding each of said signatures twice in a direction to form transverse fold lines which are substantially perpendicular to said first longitudinal fold line; and longitudinally folding each of said signatures along said hinge formed by said notches.

2. A method of producing signatures according to claim 1, further comprising the steps of transversely perforating said printed web substantially perpendicular to its direction of travel to form cross perforation lines prior to the step of transversely folding and after the step of longitudinally folding said printed web to form said first longitudinal fold line so that said transverse fold lines coincide with said cross perforation lines.

3. A method of producing signatures according to claim 1, further comprising the steps of transversely perforating said printed web substantially perpendicular to its direction of travel to form cross perforation lines prior to the step of transversely folding so that said transverse fold lines coincide with said cross perforation lines, and said cross perforation lines divide said first and second main sections into approximately thirds.

4. A method of producing signatures according to claim 1, further comprising the step of longitudinally perforating said printed web in its direction of travel to form a longitudinal perforation line prior to the step of longitudinally folding to form said first longitudinal fold line so that said first longitudinal fold line coincides said longitudinal perforation line.

5. A method of producing signatures according to claim 1, wherein said first and second main sections are substantially equal in transverse width, and the step of severing said printed web occurs before the steps of transversely folding each signature twice and before longitudinally folding each signature along said hinge.

6. A method of producing signatures according to claim 1, wherein the step of creating said notches occurs after said step of longitudinally folding to form said first longitudinal fold line, and the step of longitudinally folding each of said signatures occurs after the step of transversely folding each of said signatures twice to form transverse fold lines.

7. A method of producing signatures according to claim 1, wherein the step of providing said continuous printed web of sheet material includes providing a plurality of continuous printed webs overlying each other, and the step of severing said printed web occurs after longitudinally folding said printed web to form said first longitudinal fold line and before the step of transversely folding each of said signatures twice to form transverse fold lines and before the step of longitudinally folding each of said signatures along said hinge.

8. A method of producing signatures according to claim 1, wherein the step of transversely folding occurs after the step of longitudinally folding to form said first longitudinal fold line and before the step of longitudinally folding each of said signatures along said hinge.

9. A method of producing signatures according to claim 8, wherein said transverse fold lines formed by the step of transversely folding divides said signatures into fourths.

10. A method of producing signatures according to claim 9, wherein the step of transversely folding includes the step of folding said first and second main sections of each of said signatures into overlying quarter sections.

11. A method of producing signatures according to claim 9, wherein the step of transversely folding includes the steps of folding said signatures along a first of said transverse fold lines to fold said first and second main sections in half and then further folding said first and second main sections again in half such that said first and second main sections are folded into overlying quarter sections.

* * * * *